US005569403A

United States Patent [19]

Swanson et al.

[11] Patent Number: 5,569,403

[45] Date of Patent: Oct. 29, 1996

[54] TOWEL WARMER

[76] Inventors: John Swanson, P.O. Box 84, New York, N.Y. 10268; Lawrence Wright, 54 Cheshire Rd., Bethpage, N.Y. 11714

[21] Appl. No.: 275,251

[22] Filed: Jul. 15, 1994

[51] Int. Cl.[6] ..... H05B 3/06

[52] U.S. Cl. ..... 219/400; 219/385; 219/518; 392/379

[58] Field of Search ..... 219/385, 386, 219/391, 392, 399, 400, 402, 404; 99/355, 447, 474, 483; 392/379

[56] References Cited

U.S. PATENT DOCUMENTS

| | | | |
|---|---|---|---|
| 2,334,056 | 11/1943 | Anderson | 219/400 |
| 3,895,215 | 7/1975 | Gordon | 219/400 |
| 4,381,443 | 4/1983 | Guibert | 219/400 |
| 4,595,826 | 6/1986 | Duran et al. | 219/400 |
| 4,684,787 | 8/1987 | Bunting | 219/400 |
| 5,375,511 | 12/1994 | Huie et al. | 99/483 |

*Primary Examiner*—Tu Hoang
*Attorney, Agent, or Firm*—Richard A. Joel

[57] ABSTRACT

This invention comprises a towel warmer wherein the towel is removably mounted on a rack within a closed cabinet. The cabinet includes a heater blower mounted on the upper portion thereof and recirculating tubes on each side thereof to recirculate the warm air after it passes through the towel. The heater blower warms the circulated air and forces it downwardly into the hanging towel. The system is totally enclosed so that the operating noise is greatly reduced and the system uses only a fraction of the electric power conventionally required.

6 Claims, 2 Drawing Sheets

TOWEL WARMER

BACKGROUND OF THE INVENTION

This invention relates to towel handling devices and particularly to a towel warmer, which is relatively inexpensive and requires no installation.

The typical warmer cabinet has cool air intake vents and warm air exhaust vents. This causes the entire bathroom to heat up right along with the towel. In smaller bathrooms it gets so hot that the pleasurable effects and benefits of a warm towel are completely lost.

The towel warmer of this invention recirculates the air in a totally enclosed system. In this manner the towels are warmed rapidly and efficiently. Among the advantages of the disclosure are the fact that this system 1) uses less electric power, 2) operating noise is greatly reduced, 3) safety is improved because the system uses no vents, 4) the system can be safely and conveniently mounted on a wall, floor or any flat surface and finally 5) battery operation is possible.

Among the prior art patents is U.S. Pat. No. 4,684,787 to Bunting on an article heating cabinet which is not directly relevant.

Accordingly, an object of this invention is to provide a new and improved towel warmer.

A further object of this invention is to provide a new and improved towel warmer which is efficient, uses less power and is safe to operate.

A more specific object of this invention is to provide a new and improved towel warmer, wherein towels are heated in an enclosed environment with a heater blower which warms recirculated air to provide an efficient effective means for towel warming.

DESCRIPTION OF THE DRAWINGS

The above and other objects of this invention may be more clearly seen when viewed in conjunction with the accompanying drawings wherein.

DETAILED DESCRIPTION OF THE INVENTION

Figure 1:
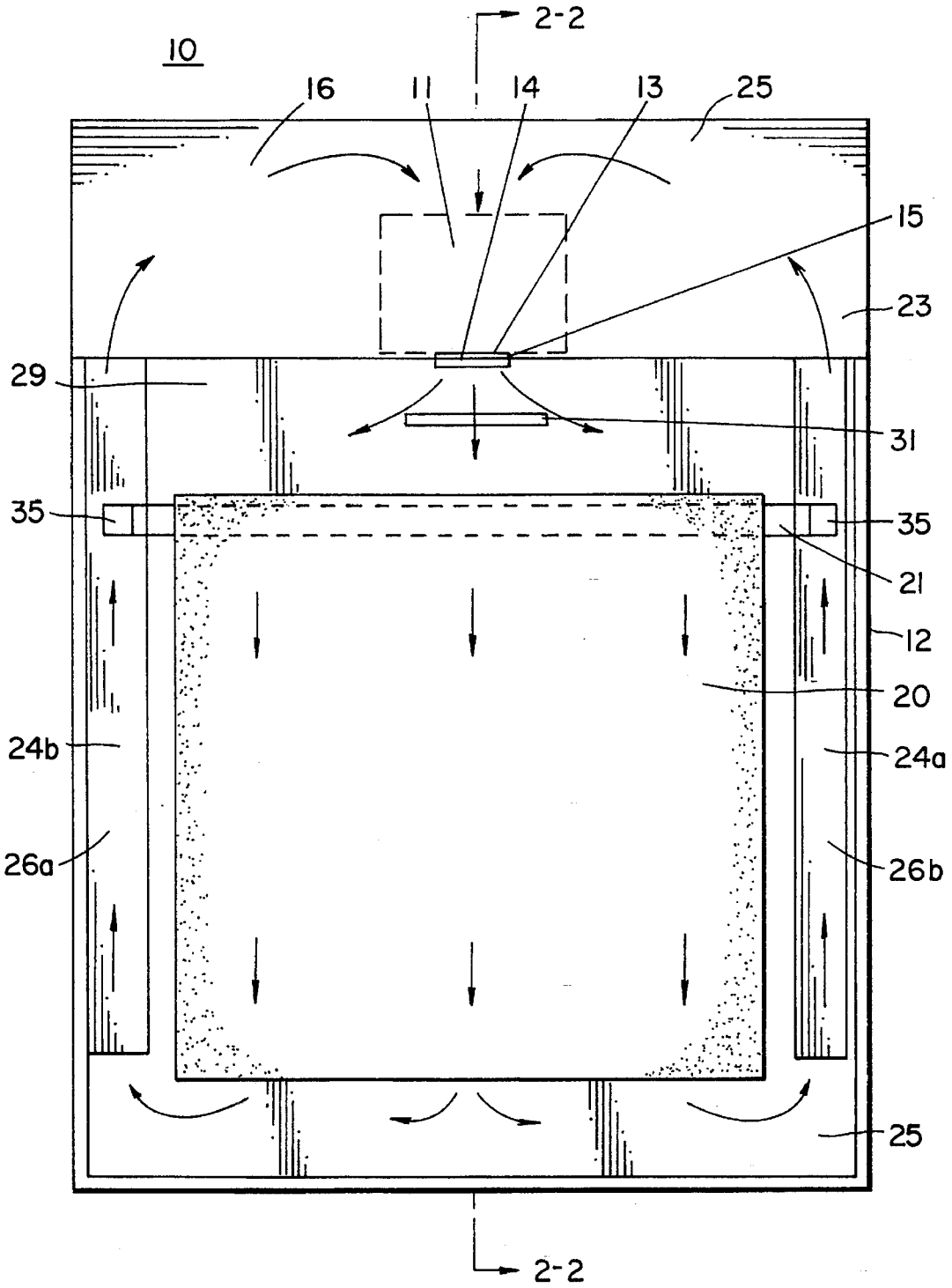
FIG. 1 is a front view of the towel warmer comprising the invention.
Figure 2:
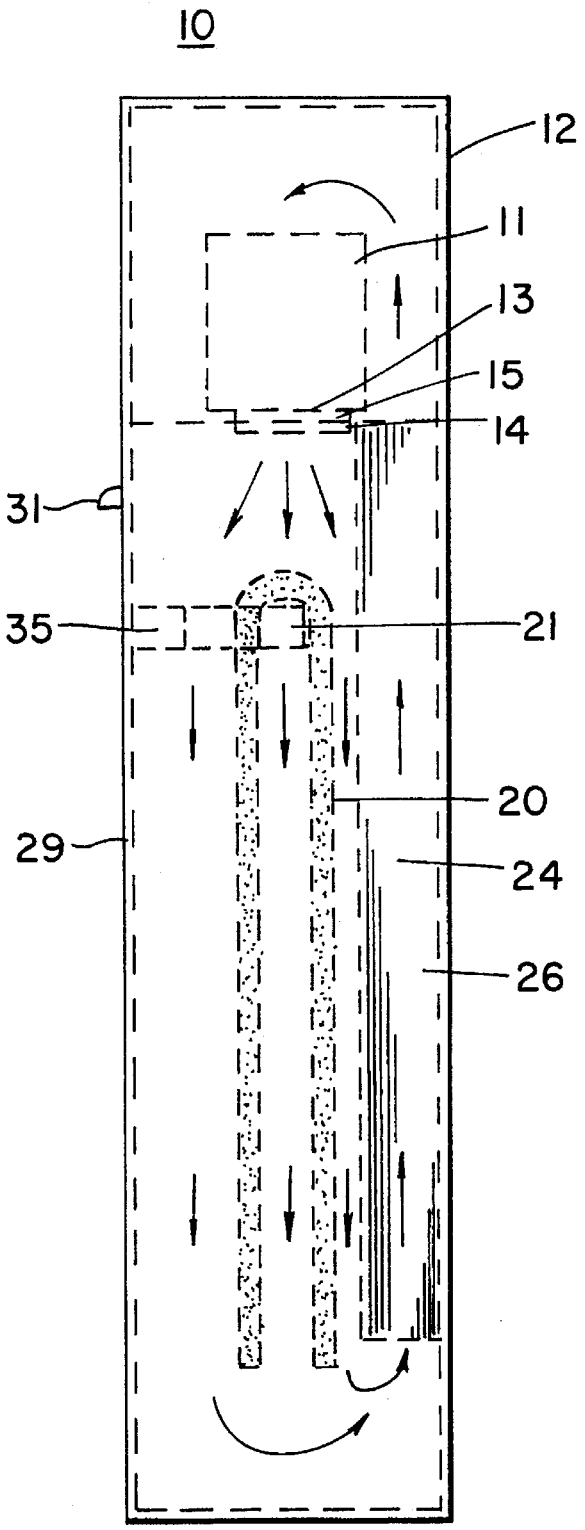
FIG. 2 is a cross-sectional view of the invention taken along line 2—2 of FIG. 1.

Referring now to the drawings, the invention comprises a towel warmer 10, which includes a heater blower 11, mounted in the upper portion of the cabinet 12. The heater 11 includes an upper aperture 13 and a lower aperture 14 through which passes a stream of heated air and is forced in the directions indicated by the arrows. The upper portion of the heater 11 is mounted through an aperture 15 in the duct 16. The heater blower 11 may comprise an electric heater and fan built as an integral unit.

The towel 20 is hung on a rack on the door 21 and hangs downwardly within the cabinet 12. Warm air from the heater 11 passes through the opening 14 which is flared outwardly and includes tapering sides 23 to direct the warmed air outwardly over the towel surface. The heated air passes downwardly through the towel 20 and then upwardly along the outer tubular members 24*a* and 24*b* on each side of the cabinet 25. The streams from the tubular members 24*a* and 24*b* pass into the upper duct 25 and downwardly into heater blower member 11 and then through the aperture 15. Passages 26*a* and 26*b* also extend downwardly adjacent to and on both sides of the towel 20.

In use the towel 20 is positioned on the door rack 21 within the cabinet 12 which includes support members 35. The door 29 of the cabinet 12 is closed by grasping handle 31 and pushing it inwardly against the cabinet 12. The heater 11 is then activated causing hot air to flow downwardly through the towel. The towel 20 can be observed during heating since the door 29 may be glass or a clear plastic. The warmer 10 is activated only when the door 29 is closed. Anytime the door 29 is opened, the system automatically shuts off. The invention proposes a towel warming system 10 which can be safely and conveniently mounted on or in a wall. The warmer 10 has the advantage of reducing operating noise and the amount of power to run the system. It is also possible to run the heater 11 on a battery (not shown).

While the invention has been explained by a detailed description of certain specific embodiments, it is understood that various modifications and substitutions can be made in any of them within the scope of the appended claims which are intended also to include equivalents of such embodiments.

What is claimed is:

1. A towel warmer comprising;

a heater blower;

a hollow cabinet having a base, upwardly extending walls and an upper portion including a top support means for a towel extending transversely between said walls therein;

a duct in the upper portion of the cabinet having a first centrally located aperture having an upper surface forming the top of the cabinet and a lower surface, said first centrally located aperture having the heater blower mounted thereto within the duct to direct a flow of warmed air downwardly against the towel, and a pair of apertures extending therethrough on the lower surface of the duct; and, a pair of elongated hollow members, having upper and lower ends extending along opposite walls of the cabinet and each being connected to an aperture in the duct at its upper end and extending above the base of the cabinet at its lower end to direct the flow of air upwardly therethrough for recycling to the heater blower.

2. A towel warmer in accordance with claim 1 further including:

a door mounted in an upwardly extending cabinet wall, and support means mounted on opposite walls at a predetermine distance below the lower duct surface each comprising journal means and a rotatable rod connected at each end to opposite journal means to hold a towel.

3. A towel warmer in accordance with claim 2 further including:

switch means mounted adjacent the door to become activated when the door is closed to operate the heater blower.

4. A towel warmer in accordance with claim 3 wherein:

the centrally located aperture includes an inlet and a tapered outlet to direct the flow of air over the towel.

5. A towel warmer in accordance with claim 1 wherein:

the heater blower comprises an integral electric heater and fan.

6. A towel warmer in accordance with claim 2 wherein:

the door comprises a glass surface to permit viewing of the towel within the cabinet.

* * * * *